United States Patent [19]

Zwilgmeyer

[11] 4,453,357

[45] Jun. 12, 1984

[54] WALL STRUCTURE, WALL ELEMENT FOR USE IN THE WALL STRUCTURE AND METHOD FOR MAKING THE SAME

[75] Inventor: Dagfinn Zwilgmeyer, Halden, Norway

[73] Assignee: Sentralinstitutt for Industriell Forskning, Oslo, Norway

[21] Appl. No.: 220,044

[22] PCT Filed: Apr. 16, 1980

[86] PCT No.: PCT/NO80/00014

§ 371 Date: Dec. 8, 1980

§ 102(e) Date: Dec. 8, 1980

[87] PCT Pub. No.: WO80/02303

PCT Pub. Date: Oct. 30, 1980

[30] Foreign Application Priority Data

Apr. 20, 1979 [NO] Norway ..... 791322

[51] Int. Cl.[3] ..... E04C 1/16; E04C 1/26; B32B 3/18

[52] U.S. Cl. ..... 52/309.8; 52/309.1; 52/309.4; 52/309.11; 52/404; 114/357; 428/317.7

[58] Field of Search ..... 52/309.8, 309.9, 309.11, 52/309.4, 80, 595, 404, 406, 407, 309.14, 108; 114/355, 357; 428/71, 322.2, 322.7, 53, 54, 55, 56, 57, 58, 60, 62, 313.3, 313.5, 313.7, 315.9, 317.1, 317.7, 319.3, 319.7, 320.2, 320.4, 320.6, 321.1; 49/501

[56] References Cited

U.S. PATENT DOCUMENTS

| | | | |
|---|---|---|---|
| 3,093,847 | 6/1953 | Strecker | 114/357 |
| 3,591,443 | 7/1971 | Cox | 114/355 |
| 3,717,247 | 2/1973 | Moore | 52/108 X |
| 3,967,671 | 7/1976 | Stanley et al. | 49/501 |
| 4,238,544 | 12/1980 | Mullet | 52/309.14 |

FOREIGN PATENT DOCUMENTS

| | | | |
|---|---|---|---|
| 401506 | 2/1970 | Australia . | |
| 2197770 | 5/1972 | Australia . | |
| 455566 | 11/1974 | Australia . | |
| 468811 | 1/1976 | Australia . | |
| 482781 | 4/1977 | Australia . | |
| 6805282 | 10/1968 | Netherlands | 52/309.8 |
| 1307868 | 2/1973 | United Kingdom . | |
| 2000725 | 1/1979 | United Kingdom | 428/317.7 |

*Primary Examiner*—John E. Murtagh
*Assistant Examiner*—Richard E. Chilcot, Jr.
*Attorney, Agent, or Firm*—Watson, Cole, Grindle & Watson

[57] ABSTRACT

A wall structure for vessels, tanks, washing towers, tubes, boat hulls and the like can be manufactured from elements consisting of a core of rigid plastic foam which on a first side is coated with a layer of non-expanded plastic which adheres to the core and preferably is of the same type as the latter, whereas the core is exposed on the opposite side. The elements have an elongated plank-like shape with opposite side surfaces having respective groove-and tongue-like design for matching mutual engagement. They can be rigidly engaged in side-by-side relationship by welding and/or gluing. On an exposed face of the assembled elements, a reinforced plastic mass which sets into a continuous layer is applied, if desired after grinding for evening out irregularities.

16 Claims, 3 Drawing Figures

WALL STRUCTURE, WALL ELEMENT FOR USE IN THE WALL STRUCTURE AND METHOD FOR MAKING THE SAME

BACKGROUND OF THE INVENTION

1. Field of The Invention

The present invention relates to a wall structure which can be used, for example, in constructing objects such as vessels, tanks, washing towers, tubes, ships' hulls, etc. The invention also relates to a wall element for making such such a wall structure, and a method of making the wall structure.

2. The Prior Art

Norwegian Patent Specification No. 132 417 discloses an apparatus for the manufacture of sectional products of expanded plastic by extruding in such a manner that only part of the surface of the sectional product has a substantially non-expanded surface skin, whereas the remaining part of the surface of the product has substantially the same cell characteristics as the interior of the product.

The wall element used in the wall structure according to present invention has certain features in common with such an extruded section, but is different insofar as the wall element according to present invention is not a final product, but only an intermediate product for the manufacture of a greater wall structure, whereas according to Norwegian Patent Specification No. 132 417 it is a question of making ledgeformed products to be used as such. Another difference resides in that the wall element according to present invention consists of a relatively thick (about 1–10 mm) layer of solid material at the surface with a sharp transition to the expanded core, whereas according to Norwegian Patent Specification No. 132 317 it is a question of an expanded plastic which is extruded in such a manner that a relatively thin surface skin is obtained, which is practically not expanded. Here there is therefore obtained a gradual transition between the surface skin and the expanded core.

The object of the present invention is to provide a continuous wall structure for vessels, tanks, washing towers, tubes, boat hulls, etc., which is strong and simple in manufacture, the structure also readily lending itself to be given the shape of a double-curved surface and comprising an outer weather-resistant layer of reinforced plastic.

SUMMARY OF THE INVENTION

The wall structure according to the invention is composed of closely adjacent wall elements consisting of a core of rigid plastic foam which on a first side not facing adjacent elements is covered with a layer of non-expanded plastic which adheres to the core and preferably is of the same type as the latter, whereas the core is exposed on the opposite side, and of a continuous layer of reinforced plastic which covers the noted opposite side and adheres to the exposed core, the elements engaging each other with matching shapes and being in addition connected to each other by welding and/or gluing.

A wall structure composed in this manner may be curved in two planes, the wall elements being capable of being bent relatively easily to the desired shape, since they do not have any layer of non-expanded plastic which surrounds the entire core. After the elements have been mutually connected, the side of the wall elements to be coated with reinforced plastic, can easily be ground or otherwise machined for obtaining a smooth and even surface on which the reinforced plastic, i.e., the plastic material and the reinforcement in the same, can be applied in a simple manner for obtaining an even and smooth exterior surface.

The wall elements are preferably elongated plank-like elements having opposite side surfaces which respectively include groove- and tongue-like shapes for mutual engagement of the elements. Preferably the elements may consist of a core of expanded PVC having a coating of non-expanded PVC on three sides. The reinforced plastic layer is preferably glass fibre-reinforced polyester or epoxy resin.

As mentioned above, the wall elements are preferably of elongated plank-like shape. They can easily be manufactured by co-extrusion.

In the manufacture of a wall structure as specified above the wall elements are assembled into desired shape, if desired with the concurrent use of templets, frames, shutterings, supporting walls or the like, the elements are glued or welded together so that the composite wall structure is preferably self-supporting, whereafter the side of the wall structure which is formed by the exposed cores of the elements, is covered with a reinforcement and a plastic mass which sets into a continuous layer, if desired after the wall structure has been ground or otherwise machined for smoothing out irregularities, especially edges at the joint between the wall elements.

The invention will now be described in more detail with reference to the drawing, which as an example shows an embodiment of a wall element and a wall structure made of such elements, as well as examples of a tubular and a double-curved wall structure that can be made in accordance with the invention.

DETAILED DESCRIPTION OF THE PREFERRED EMBODIMENTS

Figure 1:
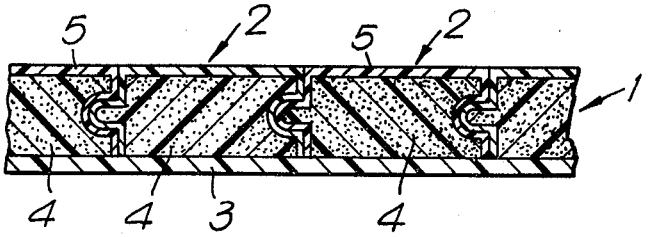
FIG. 1 is a cross-sectional view of a plane wall structure consisting of several assembled plank-like wall elements and a layer of glass fibre-reinforced polyester.

The inventive wall structure 1 as shown in FIG. 1 is composed of wall elements 2 placed beside each other, and which, after assembling, have been coated on their lower sides with a continuous layer 3 of reinforced plastic, for example, a glass fibre-reinforced polyester or epoxy resin. Each wall element 2 is made by co-extruding an expanding rigid plastic and a non-expanding plastic, the expanding rigid plastic forming a core 4 of rigid plastic foam and the non-expanding plastic forming a surface layer 5 on at least a first (upper) side of the core 4, which does not face an adjacent element. However, in the embodiment shown in FIG. 1, the co-extruded layer 5 of non-expanded plastic is shaped so that it also covers the opposed side surfaces of the core 4. The material of the layer 5 shall consist of a plastic which adheres to the core 4 and preferably is of the same type as the latter. For example, the core may consist of expanded PVC, whereas the coating 5 may consist of a non-expanded PVC. However, the core may also consist of polyurethane, polypropylene or another suitable plastic. The plastic material of the reinforced plastic layer 3 may be of a quality which will adhere to the material of the core 4. Further, the wall elements 2, which are seen to have a generally rectangular cross section, are directly interconnected, partly because their opposite side surfaces have been shaped for matching mutual engagement and partly due to welding and/or gluing. It will be understood that the design of the matching engagement shown in FIG. 1, being in the form of a groove and a tongue in opposed side surfaces, merely constitutes an example of a suitable matching engagement. By gluing the wall elements 2 together the adhesive may be evenly distributed throughout the opposed side surfaces of the wall elements, whereas in the case of welding it will be sufficient to weld the wall elements together along the upper (as shown in FIG. 1) end of the joint between the elements. For this purpose the side surfaces of the fents may be chamfered to leave room for the weld deposit and avoid any protrusion extending beyond either the upper or lower wall element surfaces.

Since the wall elements are rigidly connected to each other and since both the layer 5 and the glass fibre-reinforced plastic 3 adhere to the material of the core 4, a wall structure is obtained which is capable of sustaining relatively great forces. The structure is preferably assembled with the reinforced plastic layer 3 on the side of the wall subjected to the greatest tensional loads.

Although the wall elements 2 are preferably made by co-extrusion, it will also be possible to make them by gluing a sheet material of hard PVC into PVC foam.

Figure 2:
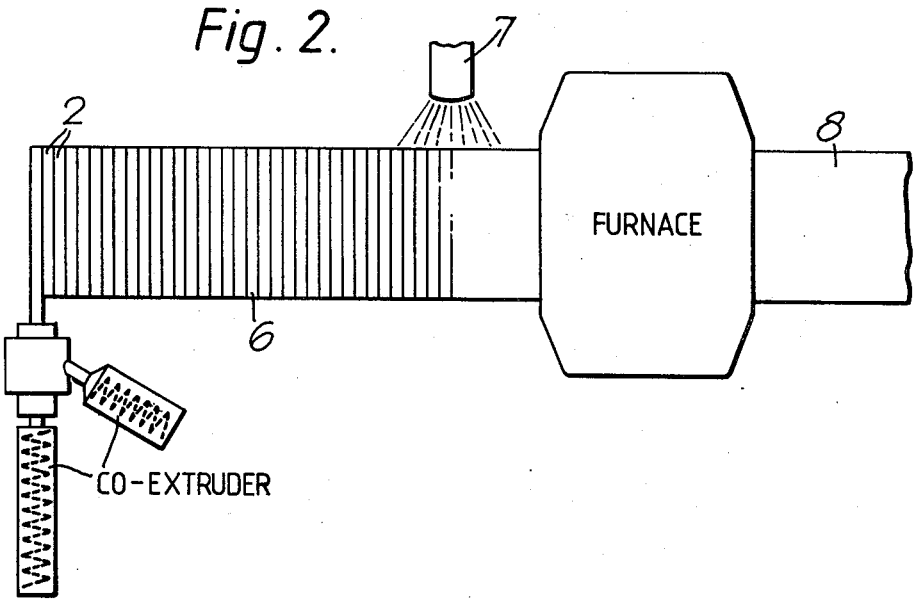
FIG. 2 shows how it is possible in accordance with the invention to make a continuous tube having a tube wall in accordance with the invention.

An important advantage of a wall element according to the invention is that it can be shaped into both single-curved and double-curved surfaces, the same being flexible since only one flat face is coated with rigid plastic. Thus, in FIG. 2 the co-extruded wall elements 2 may be wound helically into a self-supporting tube structure 6 such that the non-expanded plastic layer 5 will face the interior of the tube 6. On the outer face of the tube 6 it is possible in a conventional manner to spray a plastic mass and a reinforcement for obtaining an outer coherent reinforced plastic layer. The tube 6 is rotated so that the co-extruder may remain stationary. Such rotation of the tube also permits a spraying nozzle 7 for applying the reinforced plastic to be stationary, whereby the manufacturing machinery will be as simple as possible. After the spraying-on of the reinforced plastic, the tube is passed continuously and with continued rotation through a curing furnace. When the tube has passed through the furnace, a strong tube 8 is obtained, which has an outer layer of reinforced plastic, a core of, expanded plastic and an interior layer of for example, of PVC.

Figure 3:
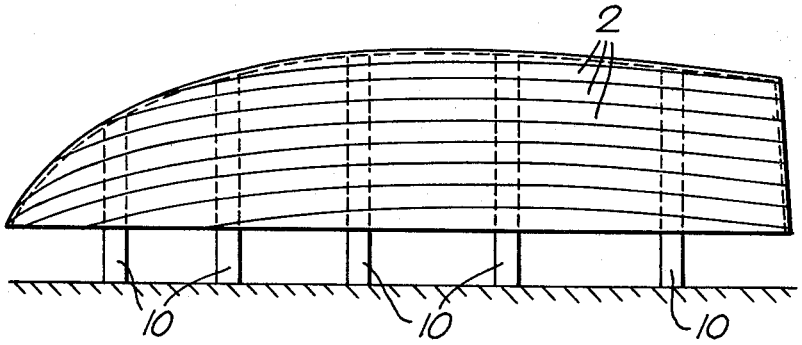
FIG. 3 shows how the wall elements according to the invention can be used for making a boat hull.

When making double-curved wall structures, the elongated plank-like wall elements 2 are preferably arranged with their longitudinal direction in the direction in which the curvature of the surface is slightest. For obtaining a relatively small radius of curvature at right angles to the longitudinal direction of the wall elements 2, these are made relatively narrow. It is then possible to assemble the elements so that they form an angle to each other in the transverse direction so as to obtain a generally curved surface composed of small chords. The face of this surface structure which is to be coated with reinforced plastic may be ground or otherwise machined for evening out the polygonal surface into an evenly curved surface, whereafter the reinforced plastic layer may be applied. In FIG. 3 it is indicated how the small plank-like wall elements 2 may be assembled into a double-curved shape on frames, or templets 10 similar to ships' frames with the layer 5 facing the templets 10. The outwardly convex shape of the assembled wall elements 2 are thereafter ground into an even, smooth surface, whereafter the layer 3 of reinforced plastic may be applied manually by spraying or the like. It will be obvious that such method of manufacture is particularly well suited for the manufacture of boat vessels in small series, for example, for amateur builders or for undertakings wanting a diversified system of models.

Even large vessels of any desired cross-sectional shape, for example, a circular cross-section with a diameter of 5–12 m and a height of 3–12 m, can easily be manufactured by applying reinforced plastic onto one face of wall elements assembled into the desired shape of the structure. The wall elements 2 may be built up against a shuttering, supporting wall or the like. This possibility has not been illustrated in detail by any figure, since it is held to be self-evident.

As indicated in FIG. 1, the layer 5 of non-expanded plastic may be thicker on one face of the wall elements 2, whereas on the opposed faces of the wall elements it is considerably thinner in order not to stiffen the elements 2 to a too great extent.

I claim:

1. A wall structure which can be used to construct objects such as vessels, tanks, washing towers, tubes and boat hulls, said wall structure comprising a multiplicity of separate, interengageable elongated wall elements, each of said elongated wall elements consisting of (a) an elongated core of expanded hard plastic and having an upper and a lower surface and opposite side surfaces, the side surfaces of each core being shaped to provide for engagement with other of said elongated wall elements adjacent thereto, and (b) a separate layer of non-expanded plastic integrally adhered by coextrusion to said core over at least its upper surface, but not its lower surface; said elongated wall elements being positioned side-to-side so as to be engaged with one another and are also adhered together, the layers of non-expanded plastic on the upper surfaces of said elongated wall elements forming a smooth but discontinuous first outer surface of said wall structure, and a single layer of reinforced plastic adhered directly to the lower surfaces of all said engaged elongated wall elements, said single layer forming a smooth, continuous second outer surface of said wall structure.

2. The wall structure of claim 1, wherein the cores of each of the elongated wall elements have generally rectangular cross sections.

3. The wall structure of claim 1, wherein one side of the core of each wall element is shaped to include a tongue and the opposite side is shaped to include a groove.

4. The wall structure of claim 1, wherein said layer of non-expanded plastic is also attached to each core along the opposite sides.

5. The wall structure of claim 1, wherein said wall elements are adhered together with welds.

6. The wall structure of claim 1, wherein said wall elements are adhered together with glue.

7. The wall structure of claim 1, wherein the core and the layer of non-expanded plastic are glued together.

8. The wall structure of claim 1, wherein at least some of said wall elements are curved in their elongated dimension.

9. The wall structure of claim 1, wherein said core is composed of expanded PVC, said non-expanded plastic is non-expanded PVC, and said reinforced plastic in said continuous layer is selected from the group consisting of glass-fiber-reinforced polyester resin and glass fiber-reinforced epoxy resin.

10. A wall element which can be used in forming a wall structure, said wall element consisting of (a) an elongated core of expanded hard plastic having an upper and a lower surface and opposite side surfaces, the opposite side surfaces of the core being shaped to provide for engagement with other wall elements, and (b) a separate layer of non-expanded plastic, said layer of non-expanded plastic being integrally adhered by coextrusion to said cover over at least its said upper surface but not its said lower surface.

11. The wall element of claim 10, wherein said core has a generally rectangular cross section.

12. The wall element of claim 10, wherein one side of the core is shaped to include a tongue and the opposite side is shaped to include a groove.

13. The wall element of claim 10, wherein said layer of non-expanded plastic is also adhered to the opposite sides of the core.

14. The wall element of claim 10 wherein the core and the layer of non-expanded plastic are glued together.

15. The wall element of claim 10, wherein it is curved in its elongated dimension.

16. The wall element of claim 10, wherein said core is composed of expanded PVC, said non-expanded plastic is non-expanded PVC.

* * * * *